United States Patent [19]

Smith et al.

[11] 4,243,287

[45] Jan. 6, 1981

[54] DEAD FRONT PLUG WITH INSULATION PENETRATING CONTACTS

[75] Inventors: Donald F. Smith, Warwick, R.I.; Michael J. Ostrelich, Easton, Conn.

[73] Assignee: General Electric Company, New York, N.Y.

[21] Appl. No.: 974,172

[22] Filed: Dec. 28, 1978

[51] Int. Cl.[3] ..... H01R 4/02

[52] U.S. Cl. ..... 339/99 R; 339/59 R; 339/107

[58] Field of Search ..... 339/99 R, 99 L, 95 R, 339/96, 97 R, 107, 62, 59

[56] References Cited

U.S. PATENT DOCUMENTS

| | | | |
|---|---|---|---|
| 1,956,018 | 4/1934 | Gilbert | 339/99 R |
| 2,678,429 | 5/1954 | Abbott | 339/99 R |
| 4,010,999 | 3/1977 | Hoffman | 339/107 |

*Primary Examiner*—Richard B. Lazarus
*Assistant Examiner*—DeWalden W. Jones
*Attorney, Agent, or Firm*—P. E. Rochford; W. C. Bernkopf; P. L. Schlamp

[57] ABSTRACT

Insulation penetrating contact of a single piece electrical blade and contact is achieved in a connector of dead front construction by providing a single piece three link insulating housing adapted to fold up in valise fashion about the single piece blade and contact and about a wire extending into the housing. Electrical contact is made as the housing is closed and fastened in close form by forcing a bladed surface of the electrical contact into a channel in which the wire to be contacted is disposed.

6 Claims, 10 Drawing Figures

DEAD FRONT PLUG WITH INSULATION PENETRATING CONTACTS

CROSS REFERENCE TO RELATED APPLICATIONS

The subject application is related to the following copending applications all of which are assigned to the same assignee as the subject application.

Ostrelich, Smith and Mellyn, Ser. No. 972,741, filed Dec. 26, 1978, entitled "DESIGN FOR A TWO PRONG ELECTRIC PLUG."

Smith, Ostrelich and Mellyn, Ser. No. 973,654, filed Dec. 26, 1978, entitled "DESIGN FOR HEAVY DUTY ELECTRIC PLUG."

Ostrelich and Smith, Ser. No. 974,173, filed Dec. 28, 1978, entitled "INTERLOCK OF BLADE AND HOUSING SIDE."

Smith and Ostrelich, Ser. No. 974,174, filed Dec. 28, 1978, entitled "DEAD FRONT PLUG WITH STRAIN RELIEF."

BACKGROUND OF THE INVENTION

The present invention relates to an electrical connector and more specifically to a connector which has a so-called "dead front" construction.

Electrical connectors which have dead front construction have no exposed parts to which wires are attached other than the electric blades which are to receive power from a receptacle or the openings to the contacts of a receptacle itself.

The concept of the use of a dead front type of construction is that it increases the safety associated with the use of connectors including both plugs for receiving electric power and receptacles for delivering electric power to plugs. In prior art devices there was access to the screws to which wires were connected through the face of the plug having the power blades extending therefrom. For many such prior art plugs there were various forms of covers that were to be placed over the face and to have the blades extending through the cover, but these covers were not always employed by the users of the plug so that when the cover was absent the screws to which wires were attached were accessible from the face. Further, any wire attached to the screws which became loose or unravelled could extend out from the plug to make contact with a user or with a metal plate into which the plug was inserted.

In recent times the standard making organizations of this country and particularly the Underwriters Laboratories has studied this problem and has determined that connectors, and particularly plugs, should have a dead front construction. The mandating of the use of dead front plugs by UL was the subject of a standard and this standard is now in force.

One patent which describes a dead front plug construction is the Hoffmann U.S. Pat. No. 4,010,999. The construction of the plug of this patent is of the so-called "valise" type. Such a valise type construction was known prior to the Hoffmann patent and was in fact shown and described in British Pat. No. 676,144.

OBJECTS OF THE INVENTION

It is one object of the present invention to provide an electrical connector which has a valise type of construction and which is economical to manufacture and reliable in its operation.

Another object is to provide a connector which is capable of being attached to a wire employing a single fastener for this purpose.

Another object is to provide a connector which is capable of having its contacts connected directly to electric wire by penetration of the wire insulation.

Another object is to provide a valise type connector capable of wire penetration type connection.

Other objects and advantages of the invention will be in part pointed out and in part apparent in the description which follows.

BRIEF STATEMENT OF THE INVENTION

The present invention is concerned with electrical connectors having an insulating housing in the form of a valise-type structure and having electrical contacts mounted within the housing. Power is supplied to the connector and particularly to the contacts of the connector through a wire extending into the insulating housing. Electrical connection between the wire and the contact within the housing is accomplished by separating the two insulated stranded wire connectors and by placing them into separate channels and by then forcing an insulation penetrating portion of the contact into the channel to penetrate the insulating covering and make contact with the conductive strands of the wire. The force necessary to cause penetration of the wire insulation is generated by an action which brings the two upper halves of the valise together. This action is effected in part in forcing the fastener of the housing into place in the device housing. Good electrical connection between the contacts of the device and the electric conductors extending into the device is accomplished in this fashion.

BRIEF DESCRIPTION OF THE DRAWINGS

The present invention will be better understood by reference to the accompanying drawings in which.

DESCRIPTION OF THE PREFERRED EMBODIMENT

With reference to the FIGURES structural details and features of the present invention are pointed out.

Figure 1:
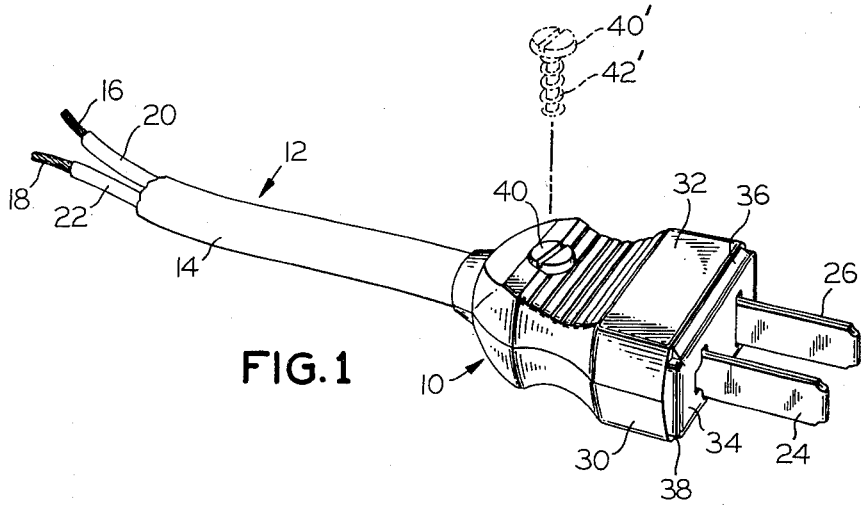
FIG. 1 is a perspective view of a plug and power supply wire as provided pursuant to the present invention.

In FIG. 1 a plug as provided pursuant to the present invention is illustrated in perspective view. The plug 10 is provided with a power supply conductor 12. The conductor has an outer insulation 14 covering two inner wires 16 and 18, each of which is provided with insulating sheaths 20 and 22. For essentially all connectors of the present invention, provision is made for receiving and retaining a conductor, such as 12, in the mechanism of the connector and for making electrical connection within the device between the conductors 16 and 18 and the electrical contacts of the device. In the case of plug 10 the contacts have the external power blades 24 and 26 which are connected respectively with the conductors 16 and 18.

The insulating housing into which the blades 24 and 26 as well as the wire 12 enters is a plastic insulating housing made up of three connected portions, two of which are side portions 30 and 32, and the other of which is a base portion 34. The side and base portions are connected by thin sections of the material which serve as webs or hinges 36 and 38. The two side portions 30 and 32 are held together by a screw member, the head of which 40 is shown in place in side 30 of housing 10. The screw head 40 is shown in phantom as 40', which with its shank 42', is poised directly above the hole in housing 10 where screw 40 is positioned to close sides 30 and 32 of the housing 10.

Figure 2:
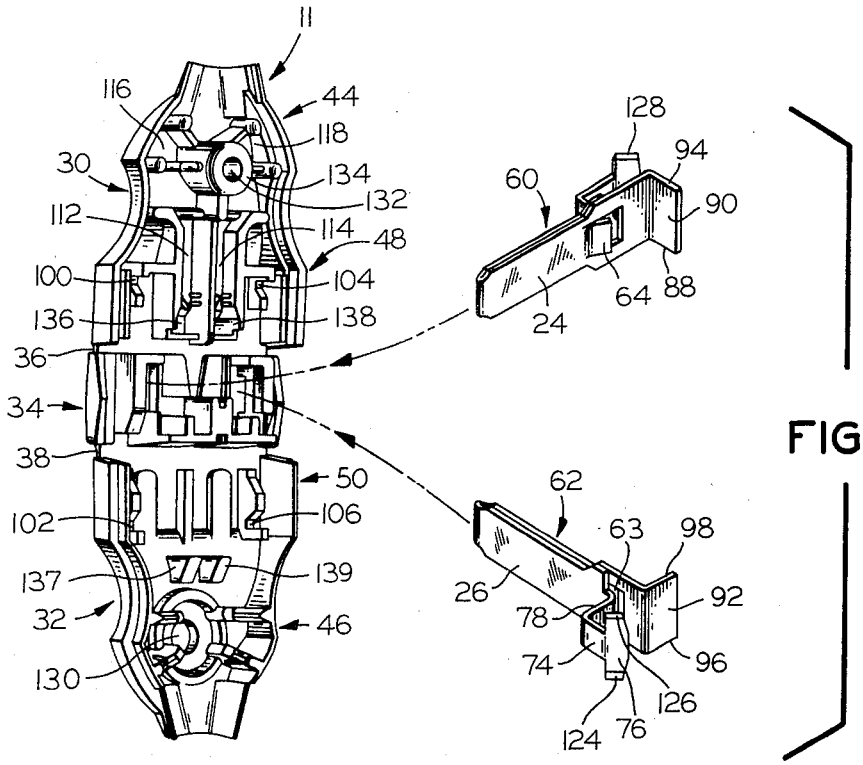
FIG. 2 is a perspective side view of the housing of the plug of FIG. 1 shown in an opened position with power blades poised for entry into the housing.

Referring next to FIG. 2, the insulating housing 11 of plug 10 is shown in an opened position with a perspective view of the interior thereof, and with the power blades 24 and 26 of the contacts 50 and 52 shown poised for insertion into receiving openings in the base 34 of the housing 11. The side portions 30 and 32 of the housing 11 are made up of cord restraining portions 44 and 46 near the point where the cord enters housing 11 and contact retaining portions 48 and 50 adjacent to the respective cord retaining portions. The base 34 is also adjacent to the contact retaining portions 48 and 50.

This base 34 receives the two contacts 60 and 62 as the blades 24 and 26 respectively are inserted through the base to occupy the position illustrated in FIG. 1. The base 34 is illustrated from the bottom in FIG. 3 with the webs 36 and 38 extending out from the base 34 to portions of the side structures 30 and 32. The blade ports 52 and 54 are the ports through which the blades 24 and 26 are inserted during assembly of the connector 10. The two latch wells 56 and 58 adjacent to the blade ports 52 and 54 respectively receive and hold a latch element as will be described below.

Figure 3:
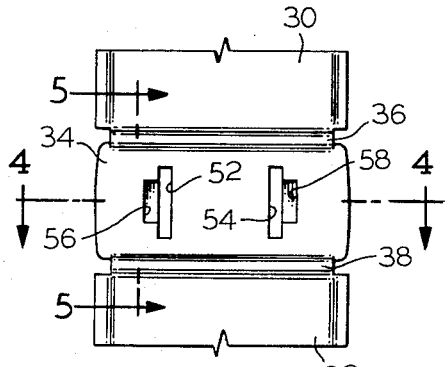
FIG. 3 is a partial plan view of the exterior of the housing of the plug of FIG. 1 also shown in an opened position.
Figure 4:
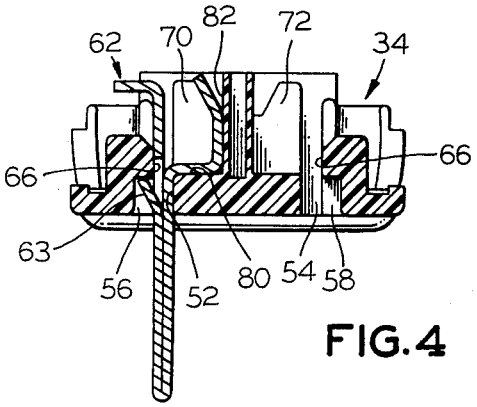
FIG. 4 is a sectional view taken along the line FIG. 4—4 of FIG. 3.
Figure 5:
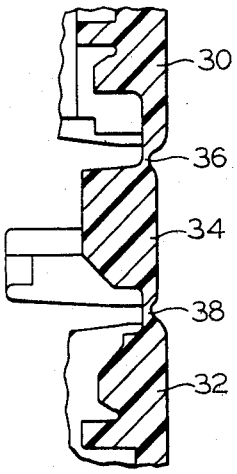
FIG. 5 is a sectional view taken along the line FIG. 5—5 of FIG. 3.

The portion of the housing illustrated in FIG. 3 is shown in section in FIGS. 4 and 5. The FIG. 4 is a transverse sectional view taken along the lines 4—4 of FIG. 3 and showing the base 34 in vertical section. FIG. 5 is a longitudinal sectional view taken along the line 5—5 of FIG. 3 and showing the base 34 and adjoining portions in section.

It will be noted particularly from contact 60 of FIG. 2 that a latch is formed by stamping the tab 64 out of the portion of contact 60 which portion is immediately above the elongated blade portion 24. The blade 24 is inserted through the blade port 52 in the manner illustrated in FIG. 2 and, as is evident from FIG. 4, such insertion will bring the tab 64 into the latch well 56 after the tab has been compressed and squeezed by the well wall 66.

As is also evident from FIG. 4, the base 34 is also provided with internal walls 70 and 72. The contact 62 has an offset arm 74 which holds the bladed end 76 of the contact 62. The offset arm 74 extends from the main axis of the contact 62 by a cross arm 78. The cross arm 78 seats within the internal well 70 on the platform 80 at the bottom of well 70. The offset arm 74 may rest against the internal side wall 82 of well 70. Similarly, the contact 60 is situated in the port 54, latchwell 58 and internal well 72 of base 34 in essentially a mirror image fashion to the situation of contact 60 in the base 34. It is evident from consideration of the configuration of the contacts 60 and 62 as well as the internal and external wells of the body 34 that when the contact is inserted in place in the base, the blade will extend out of the base for its normal purpose of insertion into a receptacle. Accordingly the contact itself will be precisely located within and held within the base 34 in a position which cannot be easily altered independently of whether or not a wire has been assembled to the device and whether or not the device has been assembled as illustrated in FIG. 1. For example, the tendency of the blade to be forced out of the base 34 as the blades are inserted into a receptacle is resisted by the tab 64 pressing against the upper wall of the well 56 and 58. Conversely where the tension is applied to the outwardly extending blade portions 24 and 26 the blade cannot be moved out of its place in the base 34 due to the cross arm 78 of the contact abutting against the platform 80 at the bottom of the internal well 70 of base 34.

The firm securing of the blade in the base is accomplished prior to any assembly of the sides of the housing 11. Accordingly, the combination of the configuration of the contacts taken together with the configuration of the base 34 provides a result which permits the connector to be assembled and contact to be made with conductors positioned therein with great ease of manufacture and assembly and with great reliability of operation and performance. The illustration of the contacts fully assembled into the base 34 is given in FIG. 10 which is a top plan view of the fully opened connector with the contacts pressed into place and held firmly in place in the base 34 of the connector.

Figure 6:
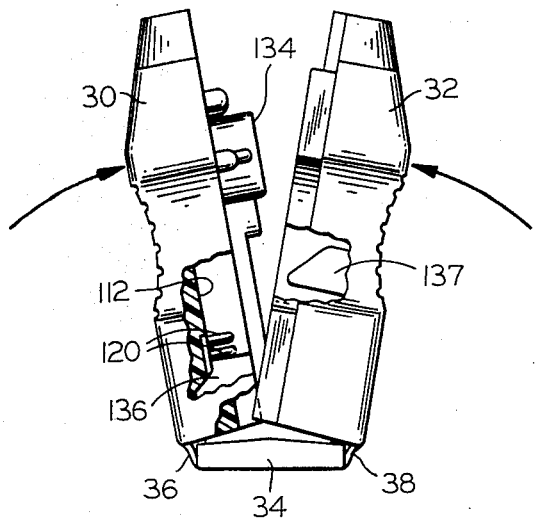
FIG. 6 is an end elevation of the insulating housing of the plug as illustrated in FIG. 1 in part broken away and illustrating the housing in a partially opened position.

Turning now to FIG. 6, there is illustrated a side elevational view in part broken away and in part in section of sides 30 and 32 of a fold up housing 11. The fold up housing is shown being folded in valise fashion to close the two sides of the housing 30 and 32 together above the base 34. The folding action takes place based on the high flexibility of the web or hinge portions 36 and 38.

Figure 7:
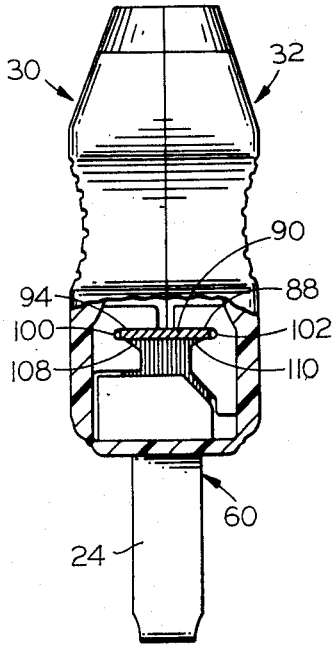
FIG. 7 is an end elevational view similar to that of FIG. 6 with the housing shown in the closed position and with the housing partially broken away to show a portion of the interior thereof.

In FIG. 7 the side elevational view of the folded connector and blade combination of the present invention, in part broken away, is illustrated with the power blades in place. In this illustration the blade 26 extends downward from the base 34 of the closed housing 10.

It will be noted accordingly that pursuant to the present invention provision is made of means by which a wiring device may operate in the opened condition, and prior to the assembly or full assembly of the device into the final closed condition as illustrated in FIG. 1.

In FIG. 2 the contacts 60 and 62 are illustrated in their position poised for entry into the base 34. Once the contacts are inserted in place they are firmly retained as part of the base and independent of the support and assistance of the two side portions 30 and 32 of the valise-like structure of the housing 11 of the connector. Accordingly, while the sides 30 and 32 of the valise do lend substantial assistance and support to the contacts, the base is able to operate and the combination of the housing 11 and the contacts 60 and 62 serve as a functioning unit for attachment of a wire such as 12 thereto in a manner to be described below. However, as furnished to the public, the unit comprises the insulating body 11 with the contacts 60 and 62 mounted therein and with an assembly screw 40 provided for the assembly of the connector unit to a wire. The unit is self-sufficient in carrying with it all of its essential ingredients and in enabling the potential user to take advantage of the novel features thereof without any equipment beyond a conventional screwdriver which is employed conventionally in the assembly of most such structures.

An interlock is provided between the contacts employed within the structure and the inner side walls of the structure. By inner side walls is meant the side wall portion visible in FIGS. 2, 8 and 10 in particular, and to a more limited degree in the other FIGURES. For example, in FIG. 7 the mode of interlock is evident through the broken away portion of the lower part of the housing of the connector shown therein.

With regard to the interlock, this interlock is accomplished principally between the upper or inner ends 90 and 92 respectively of the contacts 60 and 62 as illustrated in FIG. 2, for example. More specifically, the interlock occurs between the edges 88 and 94 of upper end 90 and conforming slots in the portions 48 and 50 of the housing 11 and between the edges 96 and 98 of upper end 92 and other conforming slots in the portions 48 and 50 of the housing 11. Still more specifically, the edge 94 interlocks with slot 100 and edge 88 interlocks with slot 102. Similarly, edge 98 interlocks with slot 104 and edge 96 interlocks with slot 106.

The actual slots are provided with a ramp surface on one side as best seen perhaps in FIG. 7. Thus the slot 100 has ramp surface 108 and slot 102 has ramp surface 110. These ramp surfaces permit the easy entry of the edges 94 and 88 of the upper end 90 of the contact element 60.

It is noteworthy that the structure described is one which permits a rapid, easy, automatic interlocking between the contacts mounted within the connector and the side walls of the connector. In this regard, the specially provided transverse portion at the upper ends of the contacts are adapted for entry in a transverse fashion into the sets of slots provided specifically therefor in the sides of the housing. Accordingly, if the webs 36 and 38, which are formed integrally with the housing as the housing itself is formed, are slit or otherwise separated to permit the side portions 30 and 32 to be separated from the base portion 34, the assembled connector will not suffer any separation of portions thereof inasmuch as the blades through their upper portions 90 and 92 provide an effective interlock with the slots 100, 102, 104 and 106. A longitudinal pull exerted either on the blades 24 and 26, or on the wire 12, of FIG. 1, will not result in a separation of the base 34 from the sides 30 and 32 due at least in part to the strong interlock formed between the ends of the contacts as set forth above and the slots into which they are automatically positioned as the connector is assembled. This assembly of the sides 30 and 32 of the connector up and about the ends 90 and 92 of the blades is accomplished as is indicated above as the sides 30 and 32 are folded up in valise fashion above the base 34 to enclose the contents of the connector 10 including the exposed portions of the wire and the inner ends of the blade from contact with the hands of the user or with instruments or tools which the user may be employing in working with the connector. Accordingly, there is provided a very effective means of accomplishing an interlocking of portions of the structure, and particularly a lateral interlocking of portions of the sides of the housing with upper or inner portions of the contacts.

Pursuant to the present invention electrical connection is made between electrical contacts 60 and 62 and the conductors such as 16 and 18 of electric supply wire 12 by interaction of a novel combination of elements as will now be explained.

Figure 8:
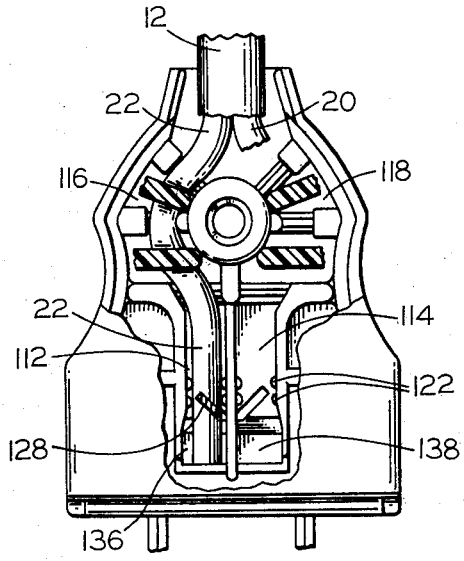
FIG. 8 is a side elevational view of the plug of FIG. 1 with portions broken away to illustrate the relationship of the parts therein.
Figure 10:
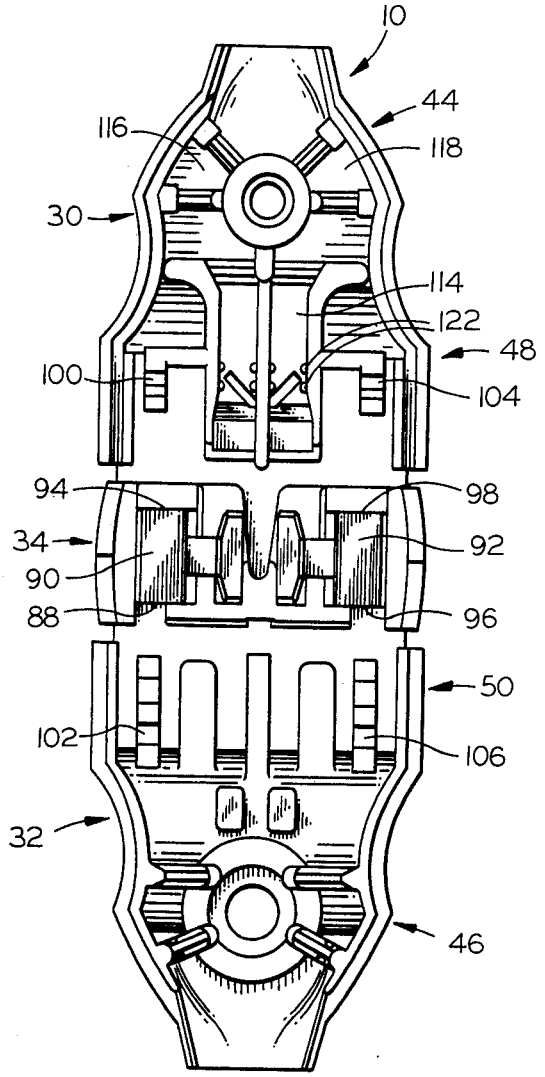
FIG. 10 is a top plan view of the insulating housing of the plug of FIG. 1 showing the housing in a fully opened position to permit viewing the interior thereof.

The conductors 16 and 18 are sheathed within the isulating sheaths 20 and 22. Pursuant to this invention the wires 20 and 22 are disposed within channels 112 and 114. To do this in the structure as illustrated in FIGS. 2 and 10 the outer sheath 12 is first removed from the wire 12, as illustrated in FIG. 1. Then the separate wires 20 and 22 are laid into the arc shaped channels 116 and 118 as best illustrated in FIG. 8. Further the ends of the insulated wires 22 and 20 extend the full length into channels 112 and 114. The insulated wires may be held in place in the channels at least in part by the lateral ribs 120 and 122 illustrated in FIGS. 2, 6, 8 and 10 as provided in pairs on each side of each longitudinal wire channel 114 and 116.

The wires 20 and 22 are placed in the channels without any need to remove any length of insulating sheath other than the center or over sheath of wire 12 when the wire has such an outer sheath. Frequently the wire is provided in the form of rip cord or two side-by-side insulated wires such as 20 and 22 having no outer sheathing but being joined along their length at the outer surface of the insulating layers thereof. The insulation of the rip cord has the general configuration of a figure 8 and the two wires are separated by ripping or cutting them along the common surface at the middle of the figure 8.

When attaching rip cord in the device of the present invention the wire insulation is split for a length sufficient to extend around the arc-shaped channels 116 and 118 and along the full length of wire channels 112 and 114 as best illustrated in FIG. 8. When such separated ends of rip cord or the exposed individual wires 20 and 22 of a jacketed wire such as 12 are positioned in place in the respective channels the electrical connection can be made simply by closing the valise-like insulating housing to cause a penetration of the insulating layer of each channelled wire by means of a sharp-edged portion of the electrical contact contained within the device.

Referring next again to FIG. 2 the contact 62 has an upper bladed end 76. The end 76 has two oppositely extending blades 124 and 126 either of which can perform the insulation penetrating function. In fact the two contacts 60 and 62 are substantially identical contacts and are each formed by the same tool. However in use they are positioned in the housing 11 so that only one of their two blades faces an insulated wire in a channel such as 112 and 114. For example, the blade 126 of contact 62 faces wire channel 114 when the contact is inserted in place in base 34 and the side 30 is folded up into its closed position against the one side of base 34. The blade 126 in fact extends into channel 114 to a depth which causes penetration of the insulation sheath of an insulated wire disposed in the channel. Simultaneously the blade 128 of contact 60 enters channel 112 and cuts through the insulating layer of any insulated wire positioned in channel 112.

A certain amount of force is needed to drive the blades 126 and 128 through insulation of wires in channels 112 and 114 and into firm electrical contact with the conduction within the insulating jacket. This force is provided in the assembly and wiring of the device by the screw 40 extending through screw opening 130 in side 32 of connector 10 and into thread receiving opening 132 in collar 134 of side 30. The screw employed is preferably of the self-tapping variety so that the screw will form its own thread in opening 132 as it is screwed into place. The use of a screw gives the device the advantage of having a higher level of force available to generate higher pressure of the blades 126 and 128 on the insulation of wires 20 and 22 and on the stranded conductors 16 and 18 within the insulation. The screw is tightened into place with a conventional screwdriver and the pressure of the blades on the wires is fully sufficient to ensure a good electrical contact by the contacts 60 and 62 with the conductors 18 and 16 respectively within the wires 22 and 20.

Positive pressure of the blades on the wires may be aided in part by the provision of bosses in the inner face of side 32 at a position proximate the blades themselves. These bosses 136 and 138 are formed integrally with housing 11. While the bosses are proximate the blades, their main function is to press the wires into the channels 112 and 114 at a location between the blades and the cord grip at the location around collar 134. The bosses positively locate the wire in the channels 112 and 114 and thus aid in having the blades operate on the wire properly located in the channels.

Also in addition to the lateral ribs 120 and 122 which further aid in properly locating and holding the wire in the channels 112 and 114 there may be wire wells 136 and 138 formed at the ends of channels 112 and 114. These wire wells receive the ends of wires such as 20 and 22 and facilitate the proper location of the wires in the channels relative to the blades which must cut through the insulation to make contact with the conductors. It is clear that the blade contact with the wire must be made at a point some distance from the end as a contact at the wire end would be too uncertain. By having the wire ends in the wells 136 and 138 greater assurance is provided that contact will be established with a part of the wire in which the conductor is present.

Figure 9:
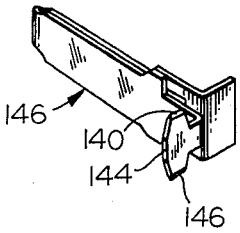
FIG. 9 is a perspective view of a power blade as used pursuant to the present invention.

From the foregoing it will be apparent that a low cost dead front connector capable of insulation penetrating contact is provided. Alternative forms of some elements of the combination may be employed. For example in FIG. 9 an alternative form of a power blade is illustrated. In this form the bladed edges 140 and 142 of bladed end 144 of contact 146 is set at approximately 90° to the longitudinal axis of the blade and of a wire to be electrically contacted by the edge 140 or 142. It is noted with respect to contact 62 that the bladed end is disposed at an angle of about 45° to the longitudinal axis of the blade as well as to the channel or trough 112 into which the bladed end moves as contact is made with a wire disposed in the trough or channel.

What is claimed and sought to be protected by Letters Patent of the United States is as follows:

1. An electrical connector adapted for insulation penetration comprising, an insulating body having a center section and two side sections adapted to fold together in valise-like formation, a pair of power blades extending through the center section of said body, the side surfaces of the inner portions of said blades having insulation penetrating cutting edges, wire receiving troughs in one side section of said insulating body, said troughs being aligned with the cutting edges of said power blades, and the cutting edges extending at least partially into said troughs, means for urging said blades into said troughs and for holding them in place therein.

2. The electrical connector of claim 1 in which the side surfaces of the inner portions are in the form of bladed edges on opposite sides of the portion of the power blades.

3. The electrical connector of claim 1 in which the blades are in the form of a strip which strip is folded at its outermost portion, and in which each blade has two side-by-side strip portions extending into said housing.

4. The electrical connector of claim 1 in which the insulation penetrating edge of the blade is set at an angle of approximately 45° to the longitudinal axis of the wire to be contacted.

5. The electrical connector of claim 1 in which the insulation penetrating edge of the blade is set at an angle of approximately 45° to 90° to the longitudinal axis of the wire to be contacted.

6. The electrical connector of claim 1 in which guide ribs are formed integrally with the wall of the receiving troughs to guide the insulation penetrating elements into contact with wires disposed in the receiving troughs.

* * * * *

UNITED STATES PATENT AND TRADEMARK OFFICE

CERTIFICATE OF CORRECTION

PATENT NO. : 4,243,287

DATED : January 6, 1981

INVENTOR(S) : Donald F. Smith and Michael J. Ostrelich

It is certified that error appears in the above-identified patent and that said Letters Patent are hereby corrected as shown below:

In the Abstract,

Line 4, delete "valise" and insert --clam shell--

In the Specification,

Column 1, line 60, first occurence, delete "valise" and insert --clam shell-- lines 60 through 62, cancel the sentence beginning with "Such a valise---." and substitute --A related form of construction was shown in British Patent No. 676,114.-- line 66, delete "valise" and insert --clam shell--

Column 2, line 7, delete "valise" and insert --clam shell-- line 17, delete "valise" and insert --clam shell-- line 30, delete "valise" and insert --clam shell--

UNITED STATES PATENT AND TRADEMARK OFFICE

CERTIFICATE OF CORRECTION

PATENT NO. : 4,243,287

DATED : January 6, 1981

INVENTOR(S) : Donald F. Smith and Michael J. Ostrelich

It is certified that error appears in the above-identified patent and that said Letters Patent are hereby corrected as shown below:

Column 5, line 1, delete "valise" and insert --clam shell--
line 2, delete "valise" and insert --clam shell--
line 67, delete "valise" and insert --clam shell--
Column 6, line 49, delete "valise" and insert --clam shell--
Column 8, line 17, delete "valise" and insert --clam shell--

Signed and Sealed this

*Fourteenth* Day of *July 1981*

[SEAL]

*Attest:*

GERALD J. MOSSINGHOFF

*Attesting Officer* *Commissioner of Patents and Trademarks*